US007781974B2

(12) United States Patent
Takada et al.

(10) Patent No.: US 7,781,974 B2
(45) Date of Patent: Aug. 24, 2010

(54) LAMP, LIGHT-EMITTING DEVICE, AND PROJECTOR

(75) Inventors: Yutaka Takada, Minami-Minowa-Mura (JP); Makoto Inoguchi, Nishitokyo (JP)

(73) Assignee: Seiko Epson Corporation, Tokyo (JP)

( * ) Notice: Subject to any disclaimer, the term of this patent is extended or adjusted under 35 U.S.C. 154(b) by 309 days.

(21) Appl. No.: 11/950,478

(22) Filed: Dec. 5, 2007

(65) Prior Publication Data

US 2008/0203883 A1 Aug. 28, 2008

(30) Foreign Application Priority Data

Dec. 14, 2006 (JP) ..... 2006-336673

(51) Int. Cl.
*H01J 17/44* (2006.01)

(52) U.S. Cl. ..... 313/594; 313/25

(58) Field of Classification Search ..... 313/594, 313/25

See application file for complete search history.

(56) References Cited

FOREIGN PATENT DOCUMENTS

| | | |
|---|---|---|
| JP | A-57-055057 | 4/1982 |
| JP | A-2006-323112 | 11/2006 |

*Primary Examiner*—Vip Patel
(74) *Attorney, Agent, or Firm*—Oliff & Berridge, PLC

(57) ABSTRACT

A lamp includes a light emitter enclosing a material emitting light upon receiving irradiation of microwave, and a coil formed on an outer side of the light emitter. In the lamp, a position of the coil with respect to the light emitter is changed in response to a temperature.

13 Claims, 9 Drawing Sheets

LAMP, LIGHT-EMITTING DEVICE, AND PROJECTOR

BACKGROUND

1. Technical Field

The present invention relates to a lamp, a light-emitting device, and a projector.

2. Related Art

A light source device that has been known in related art includes a discharge starting support member made of a metal wire and formed on a discharge lamp that emits light in an electromagnetic field of microwave. In the light source device, an intensity of the electromagnetic field inside of the discharge lamp is increased by focusing the electromagnetic field generated an end of the metal wire. (e.g. JP-A-57-55057 (page 2, FIG. 2))

A light source device disclosed in JP-A-57-55057 makes use of a focus of the electromagnetic field generated at an end of the metal wire. However, the focus of the electromagnetic field generated at the end of the metal wire is limited. Therefore, the light source device disclosed in JP-A-57-55057 has difficulties in further increasing the focus of the electromagnetic field and improving luminance of the discharge lamp.

Consequently, it is conceivable to provide a lamp and a light-emitting device including a coil. In such a lamp and a light-emitting device including a coil, an electric field component of microwave is collected by the coil. Therefore, the electric field component collected is easily focused on a light emitter of the lamp. The coil is easy to make changes in a material, a sectional area, and setting such as a coiling number, thereby facilitating a change of density of the electric field component to be focused. Therefore, the lamp and the light-emitting device including a coil become easy to increase an intensity of an electric field at a light emitter and improve luminance.

Here, the further from the coil, the lower density of the electric field component collected by the coil becomes. Therefore, in order to effectively focus the electric field component collected by the coil on the light emitter of the lamp while the density of the component is high, the coil is preferably placed closer to the light emitter of the lamp. On the other hand, the light emitter of the lamp generates heat while emitting light. Therefore, in accordance with the lamp turned on and off, the coil iteratively receives heat. It is thus conceivable that deterioration of the coil is accelerated. That is, the lamp and the light emitting device including a coil have difficulty in improving their durability.

SUMMARY

An advantage of the invention is to provide a lamp, a light emitting device, and a projector that can facilitate improvement of their durability.

A lamp according to a first aspect of the invention includes a light emitter enclosing a material emitting light upon receiving irradiation of microwave; a coil formed on an outer side of the light emitter, wherein a position of the coil with respect to the light emitter is changed in response to a temperature.

In the lamp, since an electric field component of the microwave irradiated is collected by the coil, thereby making it easy to focus the collected electric field component on the light emitter of the lamp. In the coil, changes of a material, a sectional area, and setting such as a coiling number can be easily made, thereby facilitating a change of density of the electric field component to be focused. Therefore, the lamp can make it easy to increase an intensity of an electric field at the light emitter and improve luminance.

Further, according to the configuration, the position of the coil with respect to the light emitter is changed in response to the temperature. Therefore, when the temperature becomes high, for example, the coil can be further from the light emitter. When the coil is further from the light emitter, the coil can be less likely to receive heat from the light emitter. Therefore, an amount of temperature rise at the coil is reduced, thereby lessening acceleration of deteriorating the coil. As a result, it becomes easy to improve durability of the lamp.

In the lamp described above, the position of the coil may be changed due to deformation of the coil in response to the temperature.

According to the configuration, a driving source or a driving mechanism to change the position of the coil with respect to the light emitter is not required, thereby simplifying the configuration of the lamp.

In this case, the coil may be made of a shape-memory alloy.

According to the configuration, the coil is deformed in response to the temperature, thereby changing the position of the coil with respect to the light emitter.

In this case, the shape-memory alloy may have a bi-directional property. Here, the bi-directional property represents a property indicating two figures that are a shape when the temperature is lower than the predetermined temperature and a shape when the temperature is higher than the predetermined temperature.

According to the configuration, for example, when the temperature becomes higher than the predetermined temperature, the coil is deformed so as to be further from the light emitter, while when the temperature becomes lower than the predetermined temperature, the coil can recover so as to be closer to the light emitter. Therefore, when the light emitter emits light and the temperature is increased, the coil is made to be further from the lamp, while when the light emitter stops emitting light and the temperature is decreased, the coil is made to recover to be closer to the light emitter.

In this case, the lamp may include a supporter being incorporated into an inner side of the coil, and supporting the coil at the inner side.

According to the configuration, the coil is supported by using an area inside of the coil, thereby reducing a size of the lamp.

In this case, the light emitter may have an enclosure portion including the material emitting light therein and made of a material transmitting the microwave and the light, while the supporter may be formed to extend outward from the enclosure portion.

In the lamp, the area inside of the coil and the light emitter are easily overlapped in a plane view, thereby making it easy to further focus the electric field component on the light emitter. Further, since the supporter is formed to extend from the enclosure portion, the coil is easily close to the light emitter, thereby making it easy to focus the electric field component on the light emitter effectively.

In this case, the supporter may include a first supporter and a second supporter formed opposing to each other across the enclosure portion, and the coil may be coiled around the first supporter and the second supporter from the first supporter to the second supporter crossing over the enclosure portion.

The lamp has the coil that is coiled around the supporters opposing to each other across the enclosure portion, thereby the light emitter is located on the inner side of the coil. Accordingly, it is easy to focus the electric field component on the light emitter more effectively.

A light emitting device according to a second aspect of the invention includes the lamp described above, and a microwave generator generating the microwave.

The light emitting device is provided with the lamp that is easy to increase the intensity of the electric field at the light emitter and improve durability, and the microwave generator. Therefore, the light emitting device can make the lamp easy to emit light at high luminance and facilitate improvement of durability of the light emitting device.

A light emitting device according to a third aspect of the invention includes a lamp enclosing a material emitting light upon receiving irradiation of microwave; a lamp retainer retaining the lamp; a coil located on an outer side of the lamp retained by the lamp retainer, and a microwave generator generating the microwave. A position of the coil with respect to the lamp is changed in response to a temperature.

In the light emitting device, since an electric field component of the microwave from the microwave generator is collected by the coil, thereby making it easy to focus the collected electric field component on the lamp. In the coil, changes of a material, a sectional area, and setting such as a coiling number can be easily made, thereby facilitating a change of density of the electric field component to be focused. Therefore, the light emitting device can make it easy to increase an intensity of an electric field at the lamp and improve luminance of the lamp.

Further, according to the configuration, a position of the coil with respect to the lamp is changed in response to the temperature. Therefore, when the temperature becomes high, for example, the coil can be further from the lamp. When the coil is further from the lamp, the coil can be less likely to receive heat from the lamp. Therefore, an amount of temperature rise at the coil is reduced, thereby lessening acceleration of deteriorating the coil. As a result, it becomes easy to improve durability of the light emitting device.

In this case, the position of the coil may be changed due to deformation of the coil in response to the temperature.

According to the configuration, a driving source or a driving mechanism to change the position of the coil with respect to the lamp is not required, thereby simplifying the configuration of the light emitting device.

In this case, the coil may be made of a shape-memory alloy.

According to the configuration, the coil is deformed in response to the temperature, thereby changing the position of the coil with respect to the lamp.

In this case, the shape-memory alloy may have a bi-directional property. Here, the bi-directional property represents a property indicating two figures that are a shape when the temperature is lower than the predetermined temperature and a shape when the temperature is higher than the predetermined temperature.

According to the configuration, for example, when the temperature becomes higher than the predetermined temperature, the coil is deformed so as to be further from the lamp, while when the temperature becomes lower than the predetermined temperature, the coil can recover so as to be closer to the lamp. Therefore, when the lamp lights up and the temperature is increased, the coil is made to be further from the lamp, while when the lamp goes out and the temperature is decreased, the coil is made to recover to be closer to the lamp. That is, according to the configuration, the lamp is lit up when the coil is closer to the light emitter, while when the temperature becomes high due to the lamp lit up, the coil can be further from the lamp.

The light emitting device may include a supporter being incorporated into an inner side of the coil, and supporting the coil at the inner side.

According to the configuration, the coil is supported by using an area inside of the coil, thereby reducing a size of the light emitting device.

A projector according to a fourth aspect of the invention includes a lamp enclosing a material emitting light upon receiving irradiation of microwave, a lamp retainer retaining the lamp, a coil located on an outer side of the lamp retained by the lamp retainer and changing a position thereof with respect to the lamp in response to a temperature, a microwave generator generating the microwave, a light modulator forming an optical image by modulating the light from the lamp corresponding to image data, and a projection portion projecting the optical image formed by the light modulator.

According to the configuration, an electric field component of the microwave from the microwave generator is collected by the coil, thereby making it easy to focus the collected electric field component on the lamp. In the coil, changes of a material, a sectional area, and setting such as a coiling number can be easily made, thereby facilitating a change of density of the electric field component to be focused. Therefore, the light emitting device can make it easy to increase an intensity of an electric field at the lamp and improve luminance of the lamp. Accordingly, the projector can facilitate improvement of brightness of the optical image projected through the projection portion.

Further, according to the configuration, the position of the coil with respect to the lamp is changed in response to the temperature. Therefore, when the temperature becomes high, for example, the coil can be further from the lamp. When the coil is further from the lamp, the coil can be less likely to receive heat from the lamp. Therefore, an amount of temperature rise at the coil is reduced, thereby lessening acceleration of deteriorating the coil. As a result, it becomes easy to improve durability of the projector.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
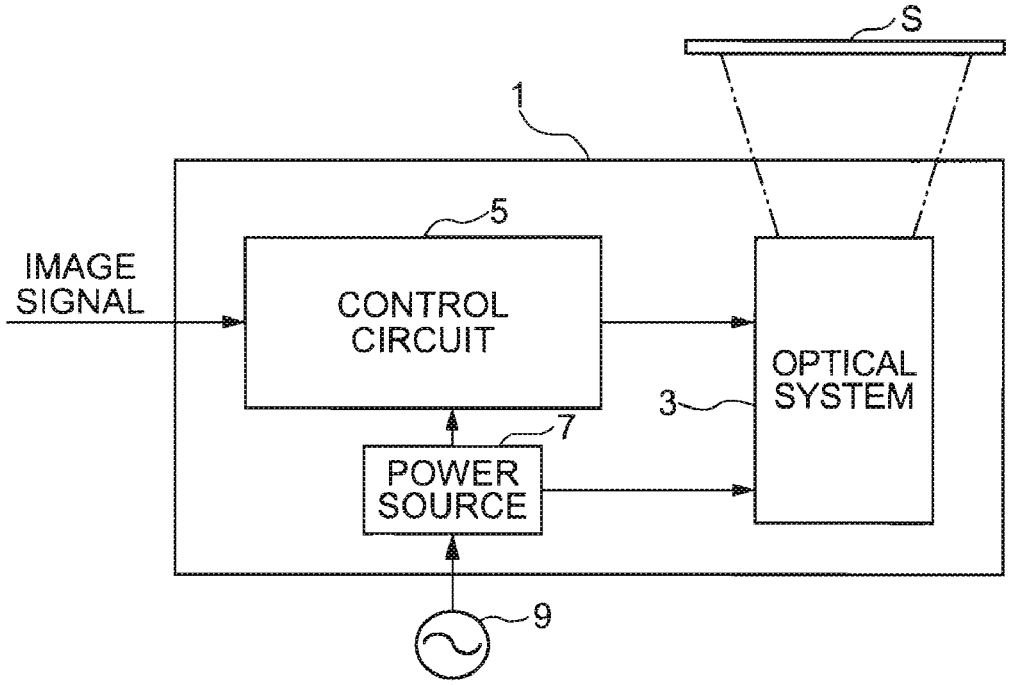
FIG. 1 is a block diagram showing a major configuration of a projector according to an embodiment of the invention.

As shown in a block diagram, FIG. 1, a projector 1 according to an embodiment of the invention is provided with an optical system 3, a control circuit 5, and a power source 7. The projector 1 projects an image corresponding to an image signal externally input onto a screen S or the like through the optical system 3. Further, in the projector 1, the power source 7 converts an alternating-current power supplied from an external power source 9 into a direct-current power, and then supplies the direct-current power to the optical system 3, the control circuit 5 and the like.

Figure 2:
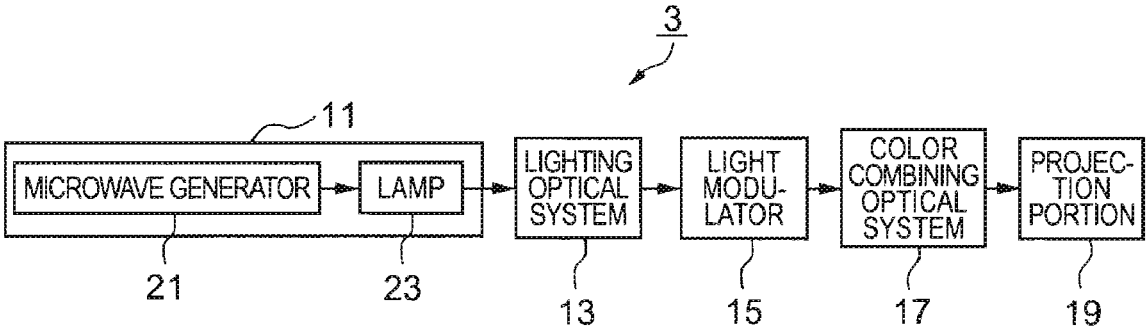
FIG. 2 is a block diagram showing a major configuration of an optical system of the projector according to the embodiment of the invention.

As shown in FIG. 2, the optical system 3 is provided with a light source device 11, a lighting optical system 13, a light modulator 15, a color combining optical system 17, and a projection portion 19. Further, the light source device 11 includes a microwave generator 21 and a lamp 23. Microwave generally indicates electromagnetic wave with a frequency of from 3 GHz to 30 GHz. However, in the embodiment, the microwave indicates electromagnetic wave in a band from 300 MHz to 30 GHz, which corresponds to from UHF band to SHF band.

The microwave generator 21 radiates microwave. The lamp 23 emits light upon receiving microwave irradiation from the microwave generator 21. The lighting optical system 13 equalizes illuminance of a light beam irradiated from the light source device 11 and divides the light beam equalized into respective light beams in red (R), green (G), and blue (B) through a dichroic mirror, a reflective mirror or the like.

The light modulator 15 has a configuration in which a liquid crystal panel is placed between a couple of polarizers formed corresponding to each color of R, G, and B, and modulates the beam of each color separated by the lighting optical system 13 corresponding to image data so as to form an optical image. The color combining optical system 17 combines the optical images of each color modulated by the light modulator 15 through a cross-dichroic prism or the like and forms a color image. The projection portion 19 projects the color image formed from the optical images of each color combined at the color combining optical system 17 through a lens or the like onto the screen S.

Figure 3:
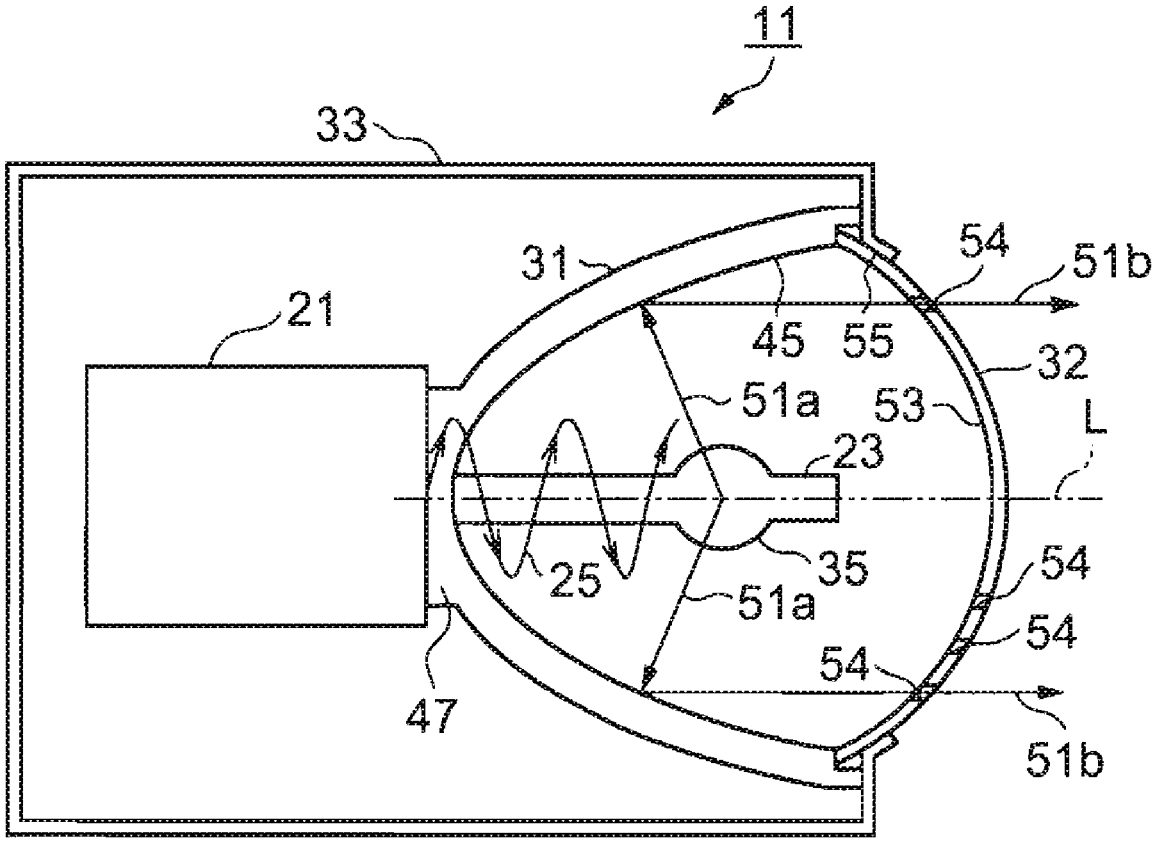
FIG. 3 is a diagram explaining a configuration of a light source device of the projector according to the embodiment of the invention.

As shown in FIG. 3, the light source device 11 is provided with a reflector 31, a reflective portion 32, and a case 33 other than the microwave generator 21 and the lamp 23 described above. In order to clarity the configuration, FIG. 3 illustrates the reflector 31, the reflective portion 32, and the case 33 in a schematic sectional view.

Here, a configuration of the lamp 23 and the reflector 31 will be explained.

Figure 4A:
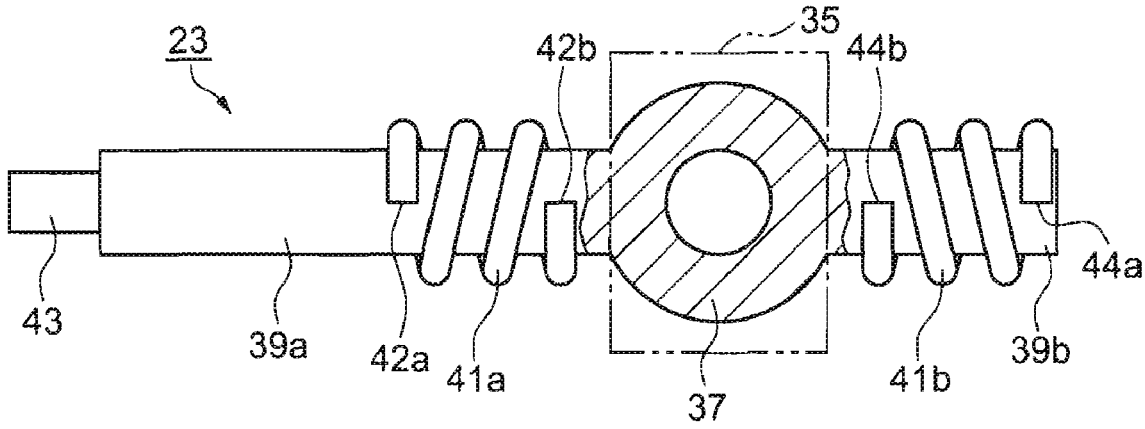
FIGS. 4A and 4B are diagrams explaining a configuration of a lamp of the projector according to the embodiment of the invention.

The lamp 23 includes a light emitter 35, supporting arms 39*a* and 39*b*, two coils, which are coils 41*a* and 41*b*, and a retained portion 43 as shown in FIG. 4A, which is a diagram explaining the configuration. The light emitter 35 emits light upon receiving a microwave irradiation.

The light emitter 35 has a configuration in which a material emitting light upon receiving a microwave irradiation is enclosed inside of an enclosure portion 37 made of silica glass, for example. In order to clarify the configuration of the light emitter 35, FIG. 4 illustrates the light emitter 35 in a sectional view.

Examples of the material enclosed in the enclosure portion 37 are noble gases such as neon, argon, krypton, and xenon, mercury, and a metallic halogen compound.

The supporting arms 39*a* and 39*b* are made of silica glass or the like, for example, and integrally formed with the enclosure portion 37 so that each of them outwardly extends from the enclosure portion 37. The supporting arms 39*a* and 39*b* are formed in positions opposing to each other across the enclosure portion 37. The retained portion 43 is formed at an end of the supporting arm 39*a* in a direction in which the supporting arm 39*a* extends. The retained portion 43 is a portion to be retained by a retainer of the reflector 31, which will be described later.

As for the two coils 41*a* and 41*b*, the coil 41*a* is supported by the supporting arm 39*a* and the coil 41*b* is supported by the supporting arm 39*b* at respective insides of the coils 41*a* and 41*b*. That is, the respective insides of the coils 41*a* and 41*b* are incorporated with the respective supporting arms 39*a* and 39*b*. The coils 41*a* and 41*b* are made of a conductive wire rod and coiled around the supporting arms 39*a* and 39*b* respectively. In the coils 41*a* and 41*b*, each of end portions 42*a* and 44*a* further from the light emitter 35 is secured to an outer circumferential surface of the respective supporting arms 39*a* and 39*b*. Further, the other ends 42*b* and 44*b*, which are closer ends to the light emitter 35, are not secured to the respective outer circumferential surfaces of the supporting arms 39*a* and 39*b*, thereby their displacement is not restricted.

Figure 4B:
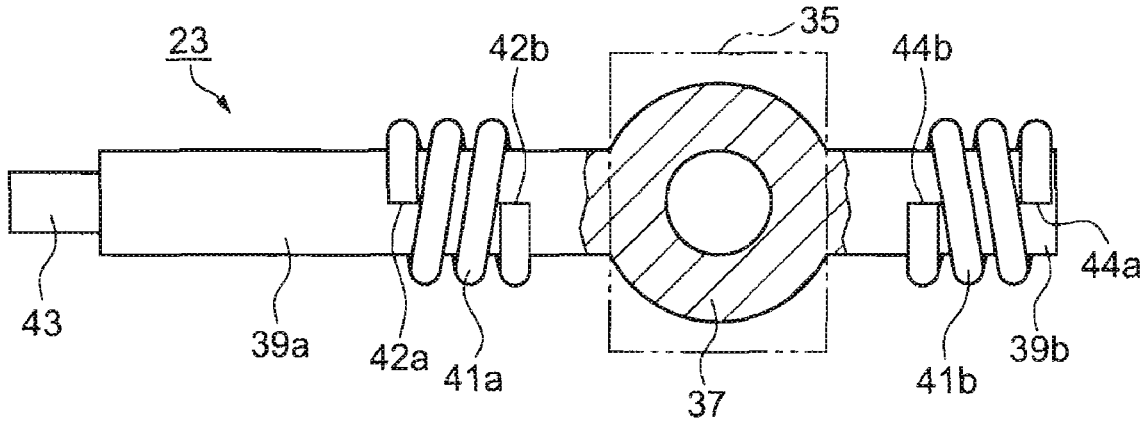

The coils 41*a* and 41*b* are made of a shape-memory alloy having a bi-directional property. When the coils 41*a* and 41*b* receive heat and their temperature is higher than a predetermined temperature, as shown in FIG. 4B that shows a state at a high temperature, each of the ends 42*b* and 44*b* changes in shape so as to be further from the light emitter 35. Accordingly, each of the coils 41*a* and 41*b* changes position with respect to the light emitter 35 so as to widen a space from the light emitter 35 to the coils 41*a* and the 41*b*.

On the other hand, when the temperature of the coils 41*a* and 41*b* becomes lower than a predetermined temperature, the shape recovers from the state shown in FIG. 4B to the state shown in FIG. 4A so as to be closer to the light emitter 35. That is, each of the coils 41*a* and 41*b* changes position with respect to the light emitter 35 so as to narrow a space from the light emitter 35 to the coils 41*a* and the 41*b*. Here, examples of the shape-memory alloy to be used are a Ti—Ni alloy, a Ti—Ni—Cu alloy, a Cu—Al alloy, and a Cu—Zn—Al alloy.

Figure 5:
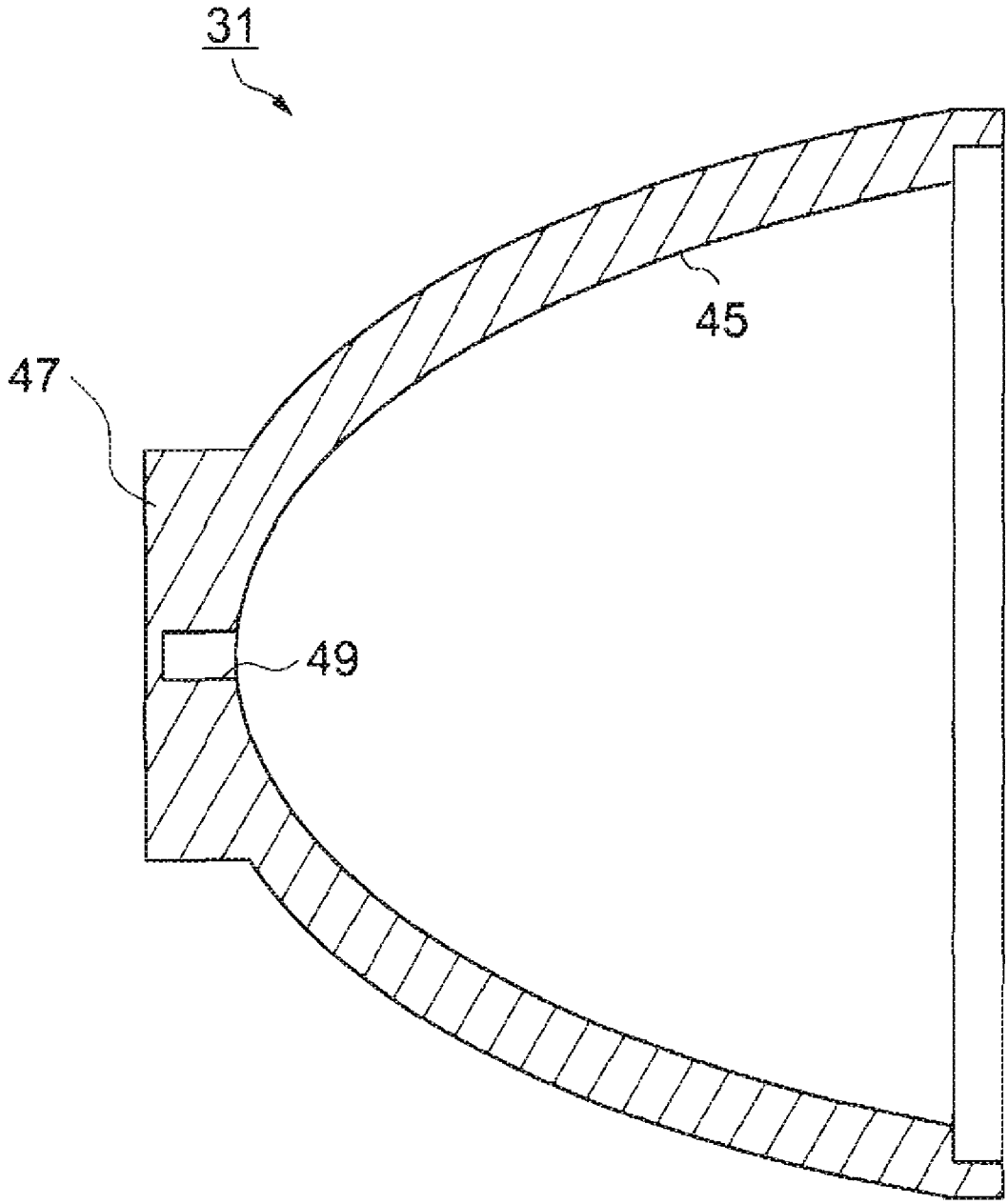
FIG. 5 is a sectional view explaining a reflector of the projector according to the embodiment of the invention.

The reflector 31 is made of silica glass or the like, for example, and includes a light-beam reflecting surface 45 having a curved surface in a paraboloidal shape formed on an inner surface thereof as shown in FIG. 5. The light-beam reflecting surface 45 is formed with a dielectric multilayer film that transmits microwave and reflects a light beam. At a peak of the paraboloidal shape of the light-beam reflecting surface 45 and an opposite side of the light-beam reflecting surface 45, that is an outer side of the reflector 31, a connector 47 that is a portion to be connected to the microwave generator 21 is formed. On the light-beam reflecting surface 45 side of the connector 47, a retainer 49 to hold the lamp 23 is formed and incorporated with the retained portion 43 of the lamp 23 shown in FIG. 4A.

In the reflector 31 having a configuration as above, the connector 47 is secured to the microwave generator 21 while the reflector 31 retains the lamp 23 as shown in FIG. 3. The paraboloidal shape of the light-beam reflecting surface 45 is formed so as to focus on the light emitter 35 located on the inner side of the reflector 31. Accordingly, a light beam 51*a* from the light emitter 35 upon receiving irradiation of microwave 25 becomes a light beam 51*b* that is nearly parallel to an optical axis L by being reflected at the light-beam reflecting surface 45. In order to clarify the configuration, the coils 41*a* and 41*b* are omitted in FIG. 3.

The reflective portion 32 is made of a metal material that is a conductive material, and includes a microwave reflective surface 53 that is a curved surface in a spherical shape as shown in FIG. 3. Further, the reflective portion 32 has a plurality of holes 54 having a diameter that is a quarter or less of a wavelength of the microwave 25. (They are simplified in the figure.) Furthermore, the spherical shape of the microwave reflective surface 53 is focused on the light emitter 35 of the lamp 23. The microwave reflective surface 53 reflects the microwave 25. The plurality of holes 54 let the light beam 51*b* reflected at the light-beam reflecting surface 45 of the reflector 31 pass through.

The case 33 is made of a conductive material in a mesh form and covers the microwave generator 21, the reflector 31, and the lamp 23 as shown in FIG. 3. The case 33 shields the microwave 25. In a surface of the case 33 corresponding to the reflective portion 32, an opening 55 in a nearly round shape is formed. A rim of the opening 55 is formed so that an inner surface thereof has a same curved surface as an outer surface of an open end of the reflective portion 32.

The reflective portion 32 is secured to the case 33 by engagement of the open end of the reflective portion 32 with the opening 55. Therefore, the light source device 11 has the reflective portion 32 projected from the case 33. The reflective portion 32 covers the microwave generator 21, the reflector 31, and the lamp 23 by working with the case 33 to shield the microwave 25.

Figure 6:
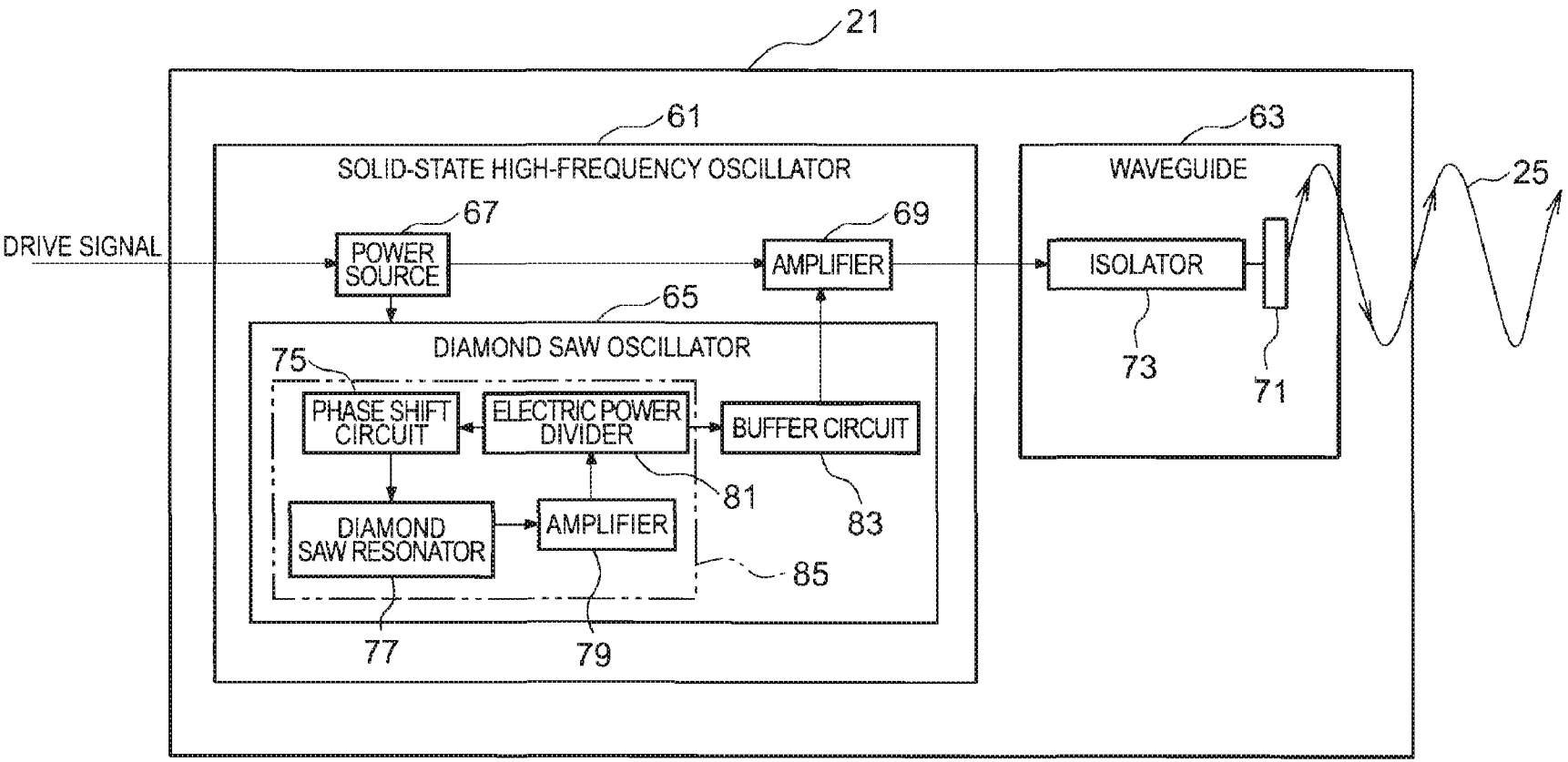
FIG. 6 is a block diagram showing a major configuration of a microwave generator of the projector according to the embodiment of the invention.

As shown in FIG. 6, the microwave generator 21 includes a solid-state high-frequency oscillator 61 and a waveguide 63. The solid-state high-frequency oscillator 61 includes a diamond surface acoustic wave (SAW) oscillator 65, a power source 67, and an amplifier 69. The waveguide 63 includes an antenna 71, and an isolator 73 serving as a cutout switch. The diamond SAW oscillator 65 includes a phase shift circuit 75, a diamond SAW resonator 77, an amplifier 79, an electric power divider 81, and a buffer circuit 83.

The power source 67 supplies an electric power to the diamond SAW oscillator 65 and the amplifier 69 based on a drive signal. The diamond SAW oscillator 65 is coupled anterior to the amplifier 69. The diamond SAW oscillator 65 generates a high frequency signal of a band of 2.45 GHz and outputs it to the amplifier 69. The amplifier 69 outputs the high frequency signal having been input to the waveguide 63 after amplifying it. At this time, the high frequency signal excites the material enclosed in the enclosure portion 37 of the lamp 23 at the amplifier 69, and is amplified to reach an output level so as to make the light emitter emit light.

The high frequency signal input to the waveguide 63 is radiated as the microwave 25 through the antenna 71. In the embodiment, the antenna 71 is a planner antenna having a configuration of a patch antenna and radiates the microwave 25 having single directivity. The microwave 25 is thus radiated as nearly plane wave by the antenna 71. Then, upon receiving the microwave 25 radiated, the material enclosed in the enclosure portion 37 of the lamp 23 is excited, and the light emitter 35 emits light. Accordingly, the lamp 23 lights up.

The isolator 73 is formed between the solid-state high-frequency oscillator 61 and the antenna 71 so as to prevent reflected wave from the reflective portion 32, the lamp 23, the case 33 or the like from returning to the solid-state high-frequency oscillator 61 so as to prevent failure of the amplifier 69 or the like.

The diamond SAW oscillator 65 has a configuration in which the buffer circuit 83 is coupled with a loop circuit 85 composed of the phase shift circuit 75, the diamond SAW resonator 77, the amplifier 79, and the electric power divider 81. The buffer circuit 83 is coupled to one of outputs of the electric power divider 81. The phase shift circuit 75 receives a control voltage from the power source 67 and changes a phase of the loop circuit 85. Each block of them is consistently coupled at a constant characteristic impedance, specifically, at 50Ω. The diamond SAW resonator 77 is coupled with an input of the amplifier 79 so that an input voltage that makes the amplifier 79 be saturated is supplied.

Accordingly, the high frequency signal in a GHz band is directly oscillated by using the diamond SAW resonator 77. Further, an output power of the amplifier 79 is output to outside through the buffer circuit 83 from the electric power divider 81 while the constant characteristic impedance remains consistent.

Further, according to the configuration of the circuit, a continuous oscillation state can continue while a minimum electric power is applied to the diamond SAW resonator 77. Furthermore, the phase shift circuit 75 enables frequency modulation of the high frequency signal. Therefore, the frequency of the microwave 25 is variable and adjustable with respect to the lamp 23. An oscillator applicable for the solid-state high-frequency oscillator 61 is not limited to the diamond SAW oscillator 65 using the diamond SAW resonator 77. It can be an oscillator using a dielectric resonator, a LC resonator or the like.

Figure 7:
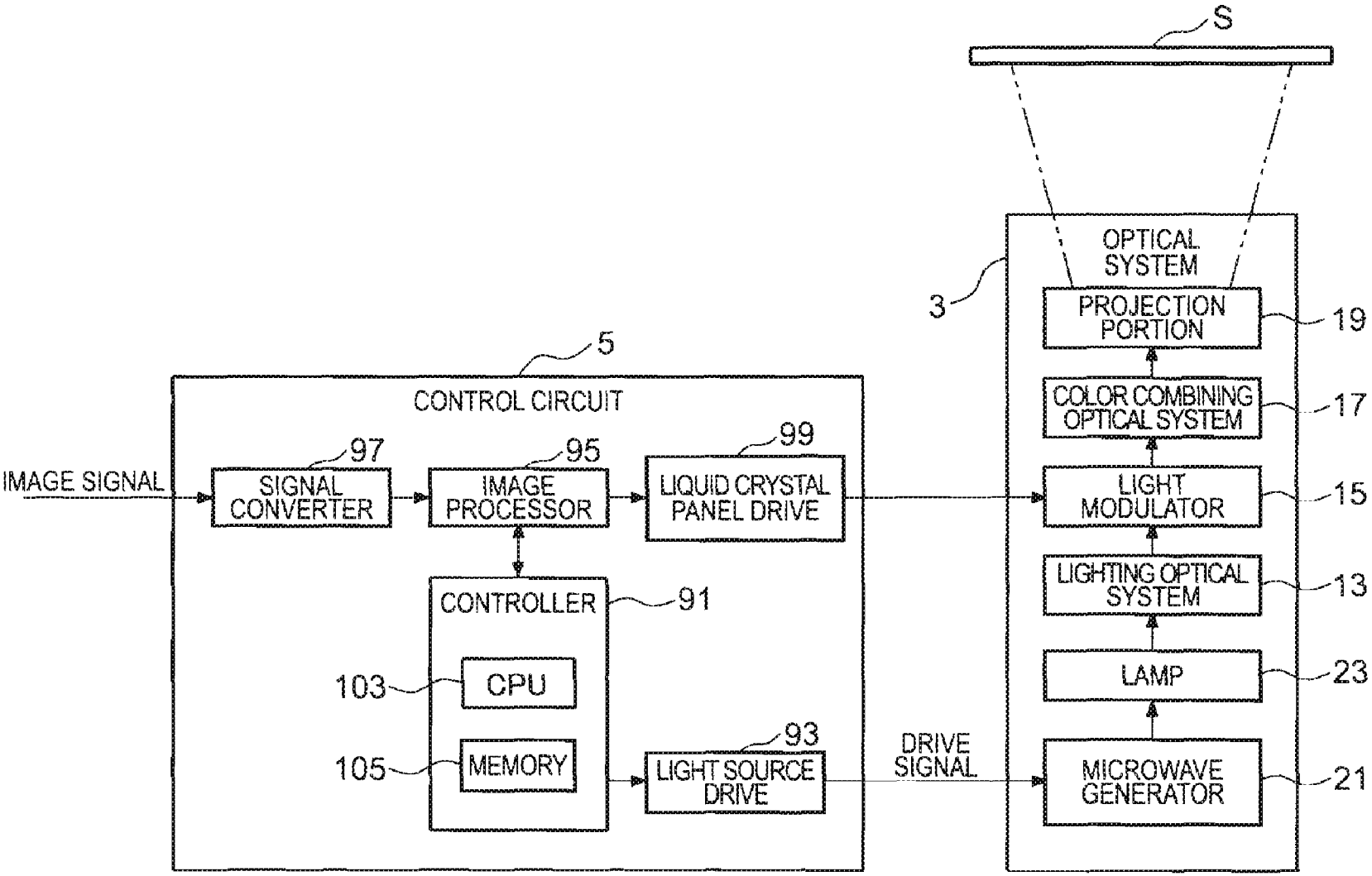
FIG. 7 is a block diagram showing a major configuration of a control circuit of the projector according to the embodiment of the invention.

As shown in FIG. 7, the control circuit 5 is provided with a controller 91, a light source drive 93, an image processor 95, a signal converter 97, and a liquid crystal panel drive 99. The controller 91 is, for example, composed of a microcomputer, and provided with a central processing unit (CPU) 103 and a memory 105.

The CPU 103 controls operation of the projector 1 overall in accordance with a control program stored in the memory 105. The memory 105 includes a read only memory (ROM) such as a flash memory and a random access memory (RAM) or the like. The ROM stores the control program to be executed by the CPU 103, or the like. The RAM provisionally develops the control program executed by the CPU 103 or provisionally stores various setting values or the like.

The light source drive 93 controls output of the drive signal to the microwave generator 21 based on a command from the controller 91, thereby turning the lamp 23 on and off.

The image processor 95 is coupled with the signal converter 97 and the liquid crystal panel drive 99, and performs various processes with respect to an image signal input to the signal converter 97 and an image forming control at the light modulator 15 based on a command from the controller 91.

The signal converter 97 converts an image signal externally supplied into image data in a form that can be processed by the image processor 95, and then outputs it to the image processor 95. The image processor 95 performs various processes on the image data input from the signal converter 97, and then outputs it to the liquid crystal panel drive 99. Examples of the processes in which the image processor 95 performs on the image data are various image quality adjustments, and a process to combine on-screen display (OSD) images such as a menu, a message and the like. Further, examples of the various image quality adjustments are a resolution conversion, a luminance adjustment, a contrast adjustment, a sharpness adjustment and the like.

The liquid crystal panel drive 99 controls drive of each liquid crystal panel composing the light modulator 15, which is not shown, corresponding to the image data being input. The liquid crystal panel drive 99 controls drive of each liquid crystal panel, so that the light modulator 15 modulates light of each color of R, G, and B so as to form an optical image. The optical image formed at the light modulator 15 is synthesized into a color image at the color combining optical system 17, and then projected onto the screen S through the projection portion 19.

In the embodiment, the light source device 11 corresponds to a light-emitting device, and the microwave generator 21 corresponds to a microwave generator. Further, the supporting arms 39*a* and 39*b* correspond to a supporter, and the coils 41*a* and 41*b* correspond to respective coils, while the retainer 49 corresponds to a lamp retainer.

In the projector 1 according to the embodiment, the lamp 23 provided with the coils 41*a* and 41*b* formed on an outer side of the light emitter 35 is used as a light source. The lamp 23 can make an electric field component of the microwave 25 irradiated from the microwave generator 21 easy to focus on the light emitter 35 by the coils 41*a* and 41*b*. Further, the coils 41*a* and 41*b* are easy to change a material, a sectional area, and setting such as a coiling number. Therefore, the lamp 23 can easily increase density of the electric field component to be focused on the light emitter 35, and improve luminance. Accordingly, the projector 1 can facilitate improvement of brightness of the optical image projected through the projection portion 19.

Here, the lamp 23 may generate heat upon projecting the optical image. This is because, the light emitter 35 of the lamp 23 may cause heat radiation when irradiating light upon receiving irradiation of the microwave 25. In such a case, the temperature of the coils 41*a* and 41*b* is increased by receiving heat from the light emitter 35. Further, each of the coils 41*a* and 41*b* is changed into the state shown in FIG. 4B from the state shown in FIG. 4A described above in response to the temperature rise, so that the space from the light emitter 35 to the coils 41*a* and the 41*b* is widened.

That is, each of the coils 41*a* and 41*b* changes position with respect to the light emitter 35 so as to be further from the light emitter 35 that is a heat source in response to the temperature rise. As above, each of the coils 41*a* and 41*b* changes position to be further from the heat source in response to the temperature, thereby reducing the temperature rise. Therefore, in the lamp 23, acceleration of deteriorating each of the coils 41*a* and 41*b* is reduced, thereby making it easy to improve durability.

Further, the coils 41*a* and 41*b* of the lamp 23 are made of a shape-memory alloy having a bi-directional property. Therefore, if the temperature of the coils 41*a* and 41*b* is lowered by turning off the lamp 23, the positions of the coils 41*a* and 41*b* recover in a direction closer to the light emitter 35 in response to the temperature drop. That is, when the lamp 23 lights up again, the coils 41*a* and 41*b* is returned to the state closer to the light emitter 35. Accordingly, when the light emitter 35 starts emitting light, the electric field component is effectively focused on the light emitter 35, thereby promptly making the light emitter 35 emit light.

Further, the lamp 23 has a configuration in which the light emitter 35 is retained by the reflector 31 through the supporting arm 39*a* and the retained portion 43. Furthermore, the lamp 23 includes the supporting arm 39*b* formed in a position opposing to the supporting arm 39*a* across the light emitter 35. Then, the coil 41*a* is supported by the supporting arm 39*a* at the inside of the coil 41*a* while the coil 41*b* is supported by the supporting arm 39*b* at the inside of the coil 41*b*. The lamp 23 includes the coils 41*a* and 41*b* supported by making use of the inside area of each of the coils 41*a* and 41*b*, thereby making it easy to prevent the lamp 23 from being large in size.

Further, in the lamp 23, each of the coils 41*a* and 41*b* has the inside area that is overlapped with the light emitter 35 in a plane view, that is, a view from a direction in which the supporting arms 39*a* and 39*b* extend, thereby further making it easy to focus the electric field component on the light emitter 35. Furthermore, each of the supporting arms 39*a* and 39*b* is integrally formed with the enclosure portion 37 so as to extend outward from the enclosure portion 37. Therefore, the coils 41*a* and 41*b* are easily close to the light emitter 35, thereby making it easy to focus the electric field component on the light emitter 35 effectively.

In the embodiment, in order to change the position of each of the coils 41*a* and 41*b* with respect to the light emitter 35, a shape-memory effect of a shape-memory alloy is used. A method to change the position of each of the coils 41*a* and 41*b* is not limited to this. Therefore, the position of each of the coils 41*a* and 41*b* may be changed by transmitting a power based on a result of detecting a temperature by a temperature sensor. However, it is preferable to use a shape-memory effect of a shape-memory alloy because a sensor, a power source, a power transmission mechanism and the like are omitted and the lamp 23 can have a simple configuration.

Figure 8:
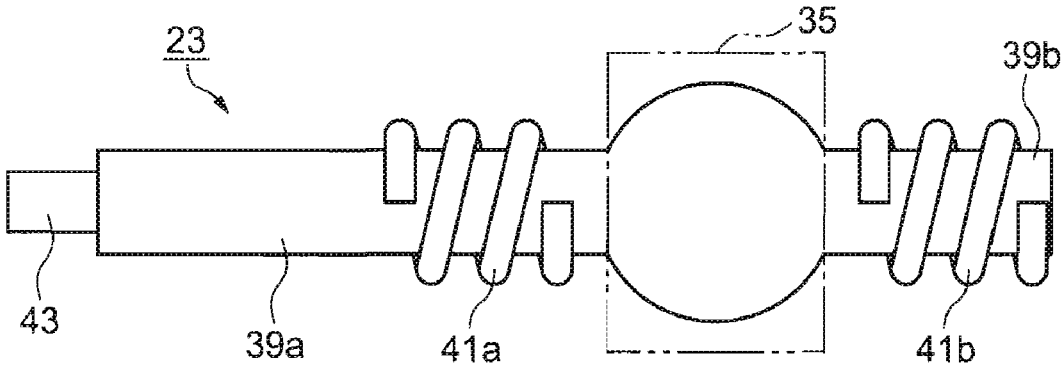
FIG. 8 is a diagram explaining a second configuration example of the lamp of the projector according to the embodiment of the invention.

Further, in the embodiment, the coils 41*a* and 41*b* are coiled so that coiling directions thereof are opposed to the other. However the coiling directions for the coils 41*a* and 41*b* can be in the same direction as shown in FIG. 8 illustrating a second configuration example of the lamp 23. In addition, the number of the coils 41*a* and 41*b* is not limited to two, and it thus can be an arbitrary number that is one or more.

Figure 9A:
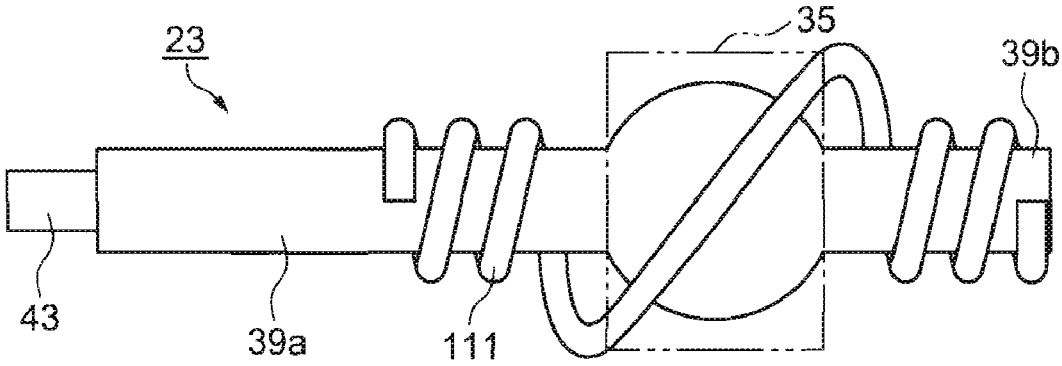
FIGS. 9A and 9B are diagrams explaining a third configuration example of the lamp of the projector according to the embodiment of the invention.
Figure 9B:
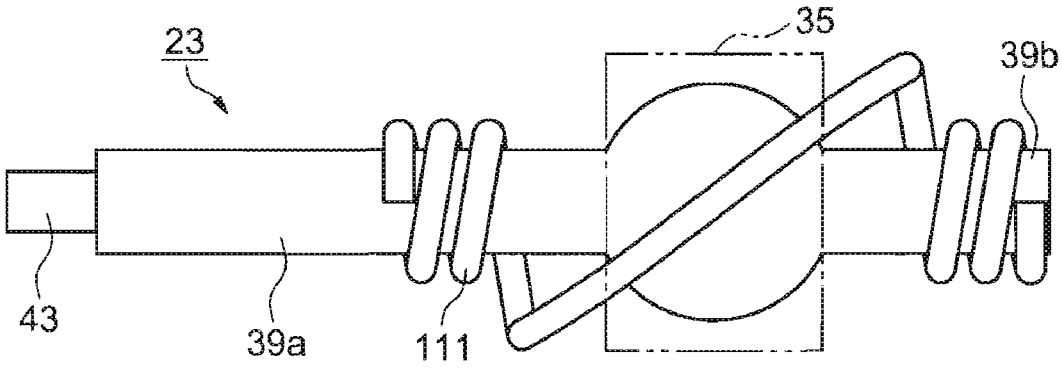

Further, in the embodiment, the lamp 23 includes two of the coils 41*a* and 41*b*. However, it is not limited to this. The lamp 23 can include a single coil, which is a coil 111 shown in FIG. 9A illustrating a third configuration example of the lamp 23. In this case, the coil 111 is coiled on the supporting arms 39*a* and 39*b* from the supporting arm 39*a* to the supporting arm 39*b* across the light emitter 35. That is, the light emitter 35 is positioned inside of the coil 111. Therefore, it is easy to focus the electric field component on the light emitter 35 more effectively. In this configuration, when the coil 111 has a temperature higher than a predetermined temperature, as shown in FIG. 9B that shows a state at a high temperature, each portion coiled around the supporting arms 39*a* and 39*b* changes shape so as to be further from the light emitter 35.

Figure 10A:
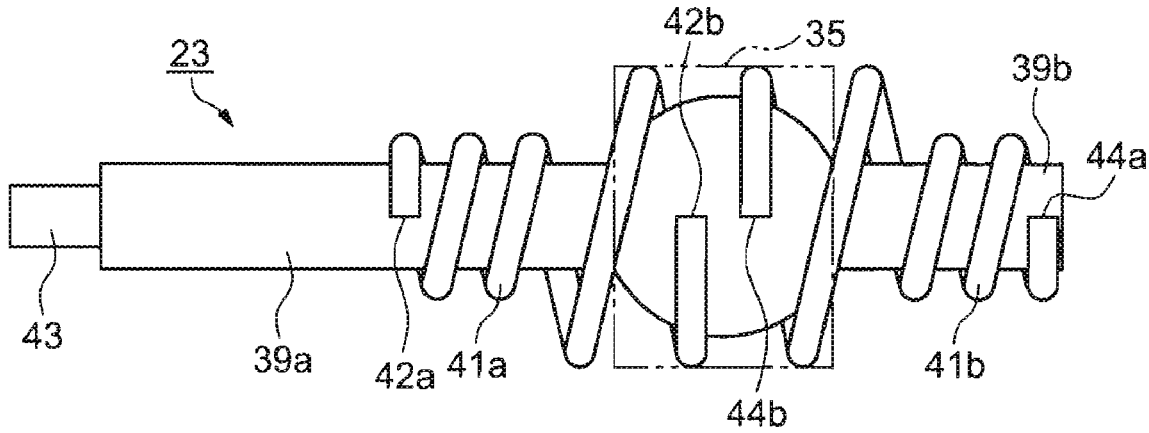
FIGS. 10A and 10B are diagrams explaining a fourth configuration example of the lamp of the projector according to the embodiment of the invention.

Further, in the embodiment, as shown in FIG. 4A, each of the ends 42*b* and 44*b* of the coils 41*a* and 41*b* are coiled around the supporting arms 39*a* and 39*b* respectively so as not to be onto the light emitter 35 to form the lamp 23. However, as it is not limited to this, the lamp 23 can have a configuration in which the ends 42*b* and 44*b* are coiled onto the light emitter 35 as shown in FIG. 10A illustrating a fourth configuration example of the lamp 23. According to the configuration, the light emitter 35 is covered with each of the coils 41*a* and 41*b* to be inside thereof, thereby making it easy to focus the electric field component on the light emitter 35 more effectively.

Figure 10B:
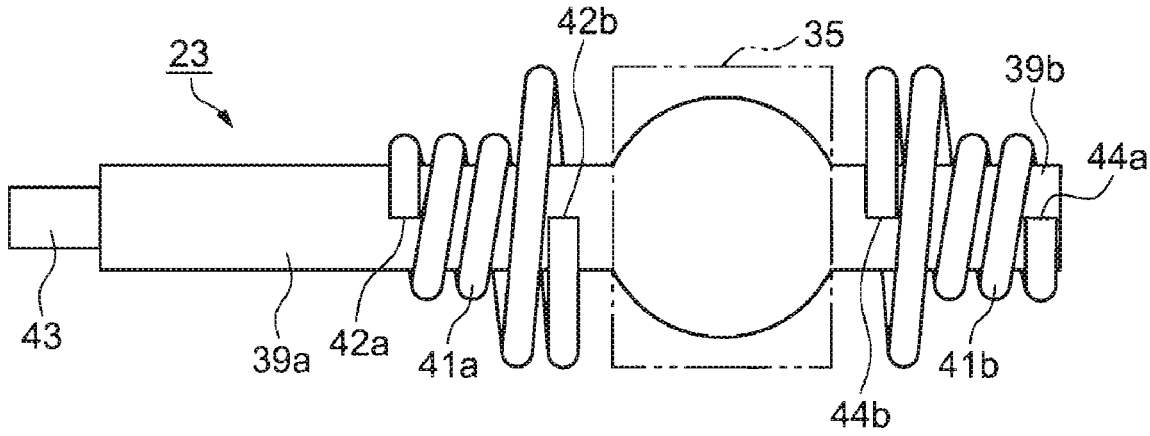

In the configuration of the lamp 23 shown in FIG. 10A, when the coils 41*a* and 41*b* have a temperature higher than a predetermined temperature, as shown in FIG. 10B that shows a state at a high temperature, each of the ends 42*b* and 44*b* changes shape so as to be further from the light emitter 35 along a direction in which each of the supporting arms 39*a* and 39*b* extends. Therefore, in the configuration, when the lamp lights up, the outer side of the light emitter 35 is released from the coils 41*a* and 41*b*, thereby making it easy to improve usability of light.

Figure 11:
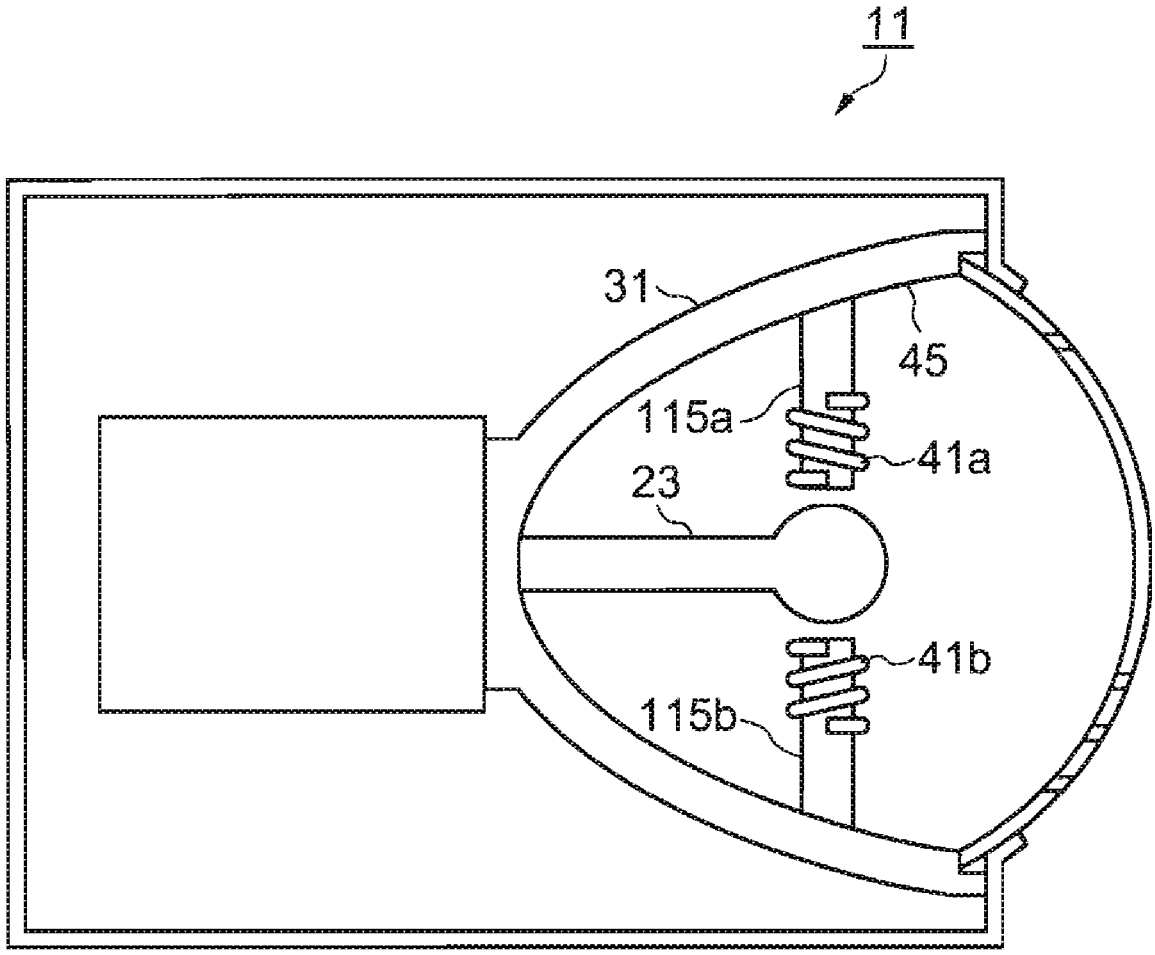
FIG. 11 is a diagram explaining another configuration example of the light source device of the projector according to the embodiment of the invention.

Further, in the embodiment, the lamp 23 supports the coils 41*a* and 41*b* by the supporting arms 39*a* and 39*b*. However, it is not limited to this, and the reflector 31 can support the coils 41*a* and 41*b*. In this case, as shown in FIG. 11, the light source device 11 has supporting arms 115*a* and 115*b* formed on the light-beam reflecting surface 45 of the reflector 31 to extend toward inside of the reflector 31. Therefore, a configuration in which the supporting arms 115*a* and 115*b* are incorporated with the coils 41*a* and 41*b* is possible. According to the above, the supporting arm 39*b* of the lamp 23 can be omitted while the coils 41*a* and 41*b* are omitted from the lamp 23, thereby reducing cost of the lamp 23.

In this case, the supporting arms 115*a* and 115*b* are preferably made of a dielectric material having magnetism so as to suppress a short circuit of the coils 41*a* and 41*b* while the electric field component is more effectively focused. An example of a highly insulating material having magnetism is a manganese zinc (MnZn) ferrite.

In the embodiment, a case in which the light source device 11 is applied to the projector 1 that is in a front type to project images on the screen S externally arranged is exemplified to explain. However, application of the light source device 11 is not limited to this. The light source device 11 can be applied to a rear type projector to project images onto a screen installed in the projector.

Further, the application of the light source device 11 is not only to the projector 1, but also to a light source for other optical apparatuses, lighting devices for ships, aircrafts, vehicles or the like, and interior lighting devices.

The entire disclosure of Japanese Patent Application No. 2006-336673, filed Dec. 14, 2006 is expressly incorporated by reference herein.

What is claimed is:

1. A lamp, comprising:

a light emitter enclosing a material emitting light upon receiving irradiation of microwave; and a coil formed on an outer side of the light emitter, the coil being made of a shape-memory alloy having a first and a second shape, the coil having the first shape when the temperature of the coil is lower than a predetermined temperature, the coil having the second shape when the temperature of the coil is higher than the predetermined temperature.

2. The lamp according to claim 1, wherein the position of the coil is changed due to deformation of the coil in response to a change in temperature of the coil.

3. The lamp according to claim 1, wherein the shape-memory alloy has a bi-directional property.

4. The lamp according to claim 1, further comprising a supporter being incorporated into an inner side of the coil, and supporting the coil at the inner side.

5. The lamp according to claim 4, wherein the light emitter has an enclosure portion including the material emitting light therein and made of a material transmitting the microwave and the light, while the supporter is formed to extend outward from the enclosure portion.

6. The lamp according to claim 5, wherein the supporter includes a first supporter and a second supporter formed opposing to each other across the enclosure portion, and the coil is coiled around the first supporter and the second supporter from the first supporter to the second supporter crossing over the enclosure portion.

7. A light emitting device, comprising;

the lamp according to claim 1; and a microwave generator generating the microwave.

8. A light emitting device, comprising:

a lamp enclosing a material emitting light upon receiving irradiation of microwave;

a lamp retainer retaining the lamp;

a coil located on an outer side of the lamp retained by the lamp retainer, the coil being made of a shape-memory alloy having a first and a second shape, the coil having the first shape when the temperature of the coil is lower than a predetermined temperature, the coil having the second shape when the temperature of the coil is higher than the predetermined temperature; and a microwave generator generating the microwave.

9. The light emitting device according to claim 8, wherein the position of the coil is changed due to deformation of the coil in response to the temperature.

10. The light emitting device according to claim 9, wherein the coil is made of a shape-memory alloy.

11. The light emitting device according to claim 10, wherein the shape-memory alloy has a bi-directional property.

12. The light emitting device according to claim 8, further comprising a supporter being incorporated into an inner side of the coil, and supporting the coil at the inner side.

13. A projector, comprising:

a lamp enclosing a material emitting light upon receiving irradiation of microwave;

a lamp retainer retaining the lamp;

a coil located on an outer side of the lamp retained by the lamp retainer, the coil being made of a shape-memory alloy having a first and a second shape, the coil having the first shape when the temperature of the coil is lower than a predetermined temperature, the coil having the second shape when the temperature of the coil is higher than the predetermined temperature;

a microwave generator generating the microwave;

a light modulator forming an optical image by modulating the light from the lamp corresponding to image data; and a projection portion projecting the optical image formed by the light modulator.

* * * * *